US006125674A

United States Patent [19]

Aramburu

[11] Patent Number: 6,125,674

[45] Date of Patent: Oct. 3, 2000

[54] SYSTEM CONSISTING OF A NONCOPYABLE KEY AND A CLOSED CYLINDER FOR SAME

[75] Inventor: Luis Angel Ruano Aramburu, San Sebastian, Spain

[73] Assignee: Talleres de Escoriaza, S.A., Spain

[21] Appl. No.: 09/094,750

[22] Filed: Jun. 15, 1998

[51] Int. Cl.[7] ..... E05B 27/06

[52] U.S. Cl. ..... 70/358; 70/395; 70/493

[58] Field of Search ..... 70/358, 357, 490, 70/492, 493, 367, 378, 395, 398, 401, 406, 409

[56] References Cited

U.S. PATENT DOCUMENTS

| | | | |
|---|---|---|---|
| Re. 30,198 | 1/1980 | Oliver et al. | 70/364 A |
| 2,578,211 | 12/1951 | Spain | 70/366 |
| 2,648,973 | 8/1953 | Spain | 70/366 |
| 2,660,876 | 12/1953 | Spain | 70/362 |
| 2,831,338 | 4/1958 | Spain | 70/419 |
| 3,002,268 | 10/1961 | Spain | 29/428 |
| 3,080,744 | 3/1963 | Spain | 70/364 |
| 3,412,588 | 11/1968 | Schwegler | 27/6 |
| 3,479,848 | 11/1969 | Golden | 70/364 |
| 3,877,267 | 4/1975 | Harris, Jr. | 27/6 |
| 4,107,966 | 8/1978 | Schlage | 27/4 |
| 4,114,411 | 9/1978 | Schlage | 70/421 |
| 4,221,121 | 9/1980 | Tietz | 27/6 |
| 4,289,002 | 9/1981 | Gretler | 70/358 |
| 4,302,957 | 12/1981 | Wolter | 70/337 |
| 4,341,102 | 7/1982 | Ku et al. | 70/358 |
| 4,343,166 | 8/1982 | Hofmann | 27/6 |
| 4,377,082 | 3/1983 | Wolter | 27/10 |
| 4,516,416 | 5/1985 | Prunbauer et al. | 70/276 |
| 4,612,787 | 9/1986 | Prunbauer et al. | 70/358 |
| 4,638,651 | 1/1987 | Surko, Jr. | 70/364 |
| 4,651,546 | 3/1987 | Evans | 70/366 |
| 4,660,396 | 4/1987 | Garro | 27/6 |
| 4,667,495 | 5/1987 | Girard et al. | 19/8 |
| 4,686,843 | 8/1987 | Martikainen et al. | 70/366 |
| 4,823,575 | 4/1989 | Florian et al. | 27/6 |
| 4,869,085 | 9/1989 | Meissner | 27/6 |

(List continued on next page.)

FOREIGN PATENT DOCUMENTS

| | | | |
|---|---|---|---|
| 0431550 | 5/1985 | European Pat. Off. . | |
| 0213069 | 6/1986 | European Pat. Off. | 27/6 |
| 2396144 | 1/1979 | France | 28/6 |
| 2492872 | 4/1982 | France | 19/6 |
| 2521201 | 8/1983 | France | 70/398 |
| 2522053 | 8/1983 | France | 70/398 |
| 2619149 | 2/1989 | France | 27/10 |
| 3314511 | 10/1984 | Germany | 27/6 |
| 3542008 | 6/1987 | Germany | 27/6 |
| 4035934 | 7/1995 | Germany | 27/6 |
| 2161204 | 1/1986 | United Kingdom | 19/2 |

OTHER PUBLICATIONS

The National Locksmith Catalog, Nov., 1998, pp. 26–35.

*Primary Examiner*—Suzanne Dino Barrett
*Attorney, Agent, or Firm*—Moore & Van Allen, PLLC; Michael G. Johnston

[57] ABSTRACT

A system having a non-duplicatable key and a lock cylinder for the key, in which the radius (4) of the non-toothed edge of the key (1), i.e., the distance between the theoretical rotation center in the key and its non-toothed edges **(1*a*), is smaller than the outside radius (5) of the rotor (3), wherein the non-toothed edge (1*a*) provides at least one blind recess (7) with the first relatively strong compression spring (9) and a safety tumbler pin (8), which can assume protruding and recessing positions in reference to the blind recess (7) in appropriate combination with the safety counter tumbler pin (10), which is inserted into the seat of the stator (2) and spring-loaded by a second relatively weak compression spring (11), wherein the contact between the safety tumbler pin (8) and the safety counter tumbler pin (10) is achieved through an opening (13) that exists in the additional plate (12), which is inserted into the rotor (3), wherein the thickness of the plate (12) equals the difference between the radius (4) of the non-toothed edge of the key and the outside radius (5)** of the rotor.

28 Claims, 2 Drawing Sheets

OTHER PUBLICATIONS

| | | | |
|---|---|---|---|
| 4,875,352 | 10/1989 | Smallegan et al. | 70/395 |
| 4,922,737 | 5/1990 | Urby | 70/337 |
| 5,016,455 | 5/1991 | Hennessy | 70/493 |
| 5,040,392 | 8/1991 | Matsuzawa | 70/369 |
| 5,123,268 | 6/1992 | Eizen | 70/359 |
| 5,131,249 | 7/1992 | Baden et al. | 19/8 |
| 5,170,651 | 12/1992 | Errani . | |
| 5,205,143 | 4/1993 | Hakkarainen et al. | 70/366 |
| 5,437,176 | 8/1995 | Keller | 70/358 |
| 5,438,857 | 8/1995 | Kleinhaeny | 27/10 |
| 5,457,974 | 10/1995 | Keller | 70/358 |
| 5,475,998 | 12/1995 | Raskevicius et al. | 70/495 |
| 5,520,035 | 5/1996 | Eizen et al. | 70/358 |
| 5,533,369 | 7/1996 | Valdajos-Gallego | 70/493 |
| 5,724,841 | 3/1998 | Botteon | 70/493 |
| 5,775,144 | 7/1998 | Pagalday | 70/358 |
| 5,778,712 | 7/1998 | Wallden | 70/453 |
| 5,784,910 | 7/1998 | Eizen et al. | 70/395 |
| 5,819,566 | 10/1998 | Eden, Jr. | 70/358 |
| 5,823,030 | 10/1998 | Theriault et al. | 70/419 |
| 5,839,308 | 11/1998 | Eizen et al. | 70/358 |

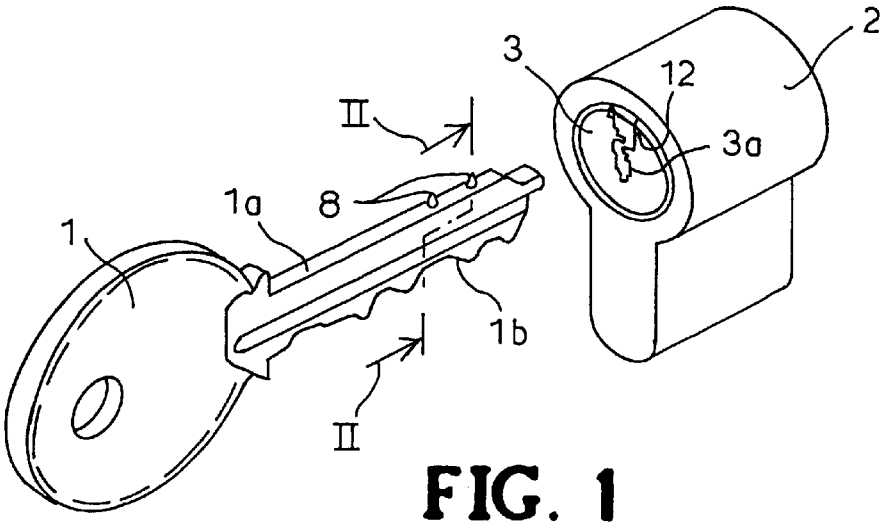
FIG. 1
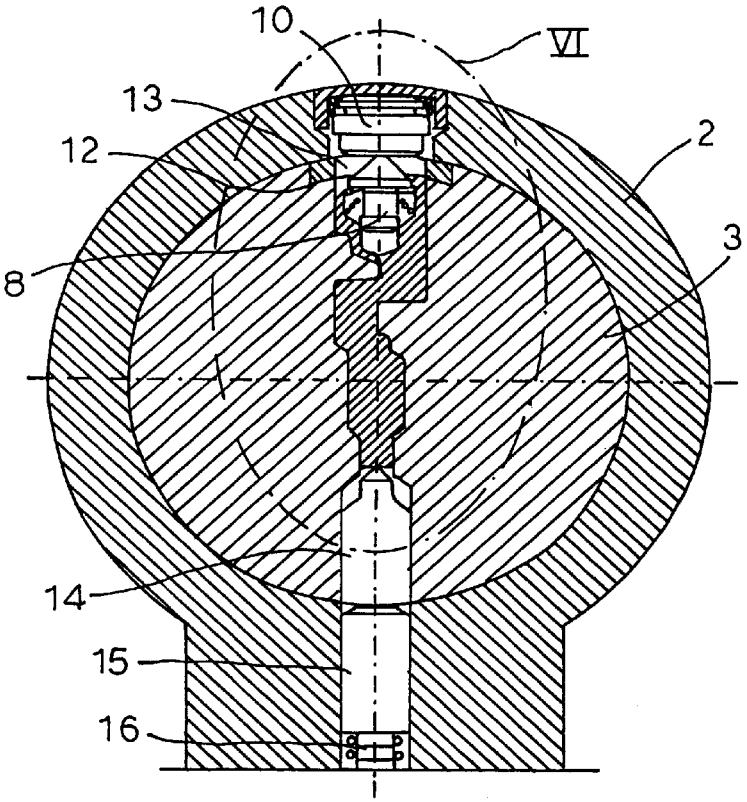
FIG. 2
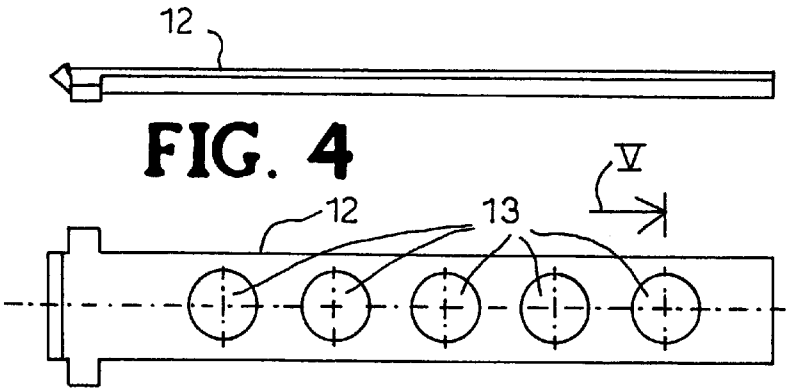
FIG. 3
FIG. 4
FIG. 5

SYSTEM CONSISTING OF A NONCOPYABLE KEY AND A CLOSED CYLINDER FOR SAME

SCOPE OF THE INVENTION

The system according to the present invention is particularly intended for use on a key of the type with a toothed stem, wherein this stem has a smooth edge and a toothed edge with a succession of recesses and projections forming the lock secret in connection with respective sets of main tumbler pins and main counter tumbler pins that are spring loaded in the interior of a respective unit having a stator and a rotor, which pins form a closing cylinder, preferably of the type with a European profile. Thus, in the absence of a key, these main counter tumbler pins span the plane of rotation of the rotor, which prevents the opening rotation, whereas the sets of tumbler pins and counter tumbler pins are rearranged such that when the correct key is inserted into the key canal, that the plane of separation between the tumbler pin and the counter tumbler pin of each set is in accordance with the plane of rotation of the rotor thus facilitating the opening rotation of the rotor.

CONVENTIONAL TECHNOLOGY

With these keys it is desirable to introduce any additional condition that has to be met simultaneously, such as the main lock secret that deviates from the tooth system, that it is as difficult as possible to duplicate the key outside of the control of the original manufacturer.

One possibility for creating an additional condition for the non-reversibility is achieved via an additional safety tumbler pin that interacts with one of the safety counter tumbler pins, which is arranged in the stator or the housing, in the same way as the sets of tumbler pins and counter tumbler pins in the main combination.

The non-toothed edge of the stem of the key is suitable for inserting such an additional tumbler pin that prevents duplication, because this part has the greatest material thickness available without the interference of the longitudinal labyrinth-like fluting or the combination tooth system of the toothed edge. With this method, however, the problem arises that when the key is inserted into the rotor, it is exactly this non-toothed edge that fulfills the function to continuously form the cylindrical circumference of the rotor, whereas the material of the rotor that has been removed by broaching is replaced. This means that the non-toothed edge of the key is aligned flush-fitting with the inside wall of the stator, which prevents that any desirable condition of rotation blocking on the basis of tumbler pins and counter tumbler pins is created.

EXPLANATION OF THE INVENTION AND ADVANTAGES

The novel suggested system results in a means for attaining the object of the invention that facilitates the insertion of one or a plurality of tumbler pins into the non-toothed edge of the key to achieve non-duplicability, wherein the above problem is eliminated.

The function of this innovative system is that the distance between the theoretical center of rotation and its non-toothed edge of the key, i.e., the radius of the non-toothed edge is smaller than the outside radius of the rotor, and that this non-toothed edge includes at least one blind recess with a relatively strong first compression spring and one safety tumbler pin, which can assume protruding and recessing positions in reference to the blind recess in conformity with the respective conditions of extension and compression of the spring such that when the key is inserted in the correct combination, this safety tumbler pin is aligned radially and is in contact with a safety counter tumbler pin that is inserted in a seat of the stator and that is spring-loaded via a second relatively weak compression spring, wherein this counter tumbler pin can assume protruding and recessing positions in this seat according to the extended or compressed condition of the second spring and further that the contact between the safety tumbler pin and the safety counter tumbler pin is achieved via an opening in an additional plate that is inserted into the rotor, wherein the thickness of this plate equals the difference between the radius of the non-toothed edge of the key and the outer radius of the rotor, whereas the safety tumbler pins fit on positions longitudinally that do not coincide with the sets of tumbler pins and counter tumbler pins of the main lock secret or the opening lock secret.

When the key is inserted, this new system results in a radial difference in the key canal of the rotor or in a radial play into which the additional plate is inserted, the plate having a material thickness necessary for rotational blocking to be achieved via one or a plurality of safety counter tumbler pins that are arranged in the seat in the stator and that interact in combination with the respective safety tumbler pins of the non-toothed edge of the key through the respective openings, which are arranged in the additional plate longitudinally with the sets of tumbler pins and counter tumbler pins of the main combination of the lock secret of the lock cylinder in a nonaligned way.

According to further characteristics of the invention, this safety tumbler pin includes a protruding head and an end part that is internally guided, whereas this head has a preferably tapered recess at its connection point with the end part, which recess provides support for the respective end of the first spring.

Thus, a gain regarding the axial stroke is achieved that is available for the safety tumbler pin, which is particularly advantageous considering the narrow space available in these arrangements.

For this purpose, the safety counter tumbler pin also has a protruding head and an internally guided end part, whereas this head has a recess at its connection point with the end part, which recess provides support for the respective end of the second spring.

DRAWINGS AND REFERENCE NUMERALS

For better understanding of the characteristics of the present invention, the attached drawings illustrate a preferred commercial embodiment, which only serves as a description, but which is not a limiting example.

FIG. 1 is a perspective view that shows key 1 according to the invention in a position prior to the insertion into respective safety lock cylinder 2, 3.

FIG. 2 shows an enlarged cross section in which key 1 according to FIG. 1 is inserted into lock cylinder 2,3, whereas this section is arranged parallel to the section line that is shown in FIG. 1.

FIG. 3 is a top view from above onto additional plate 12, e.g., the top view onto the circumference of rotor 3, when this additional plate 12 is inserted into rotor 3.

FIG. 4 is a longitudinal profile view of additional plate 12 that corresponds with the one in FIG. 3.

FIG. 5 is a section view parallel to line V—V that is shown in FIG. 3.

Figure 6:
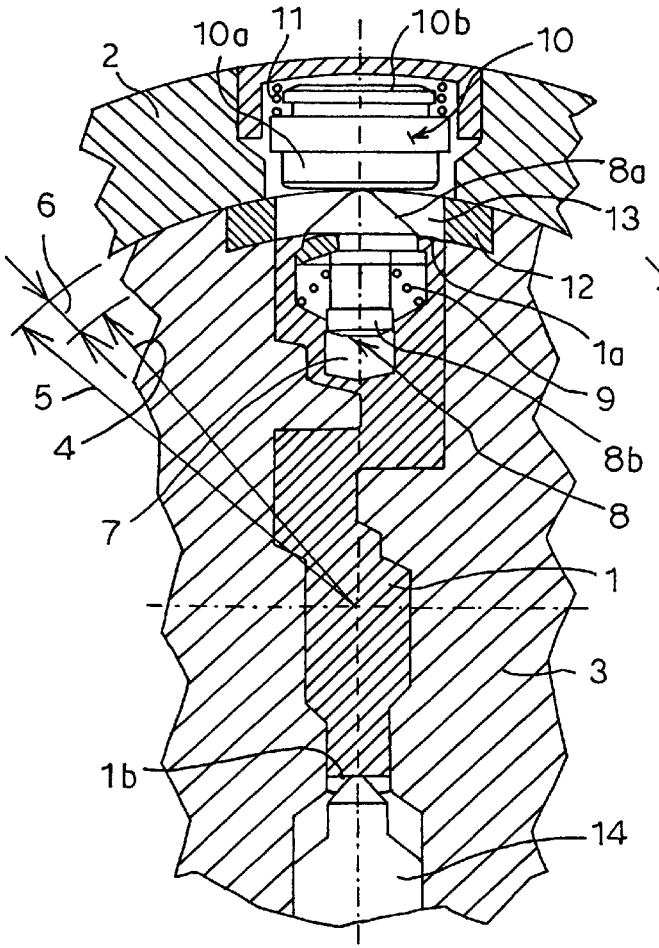

FIG. 6 shows detail VI enlarged that is surrounded by dotted lines in FIG. 2, and which shows the design of the inventive system as well as the rotation unlocking position between safety tumbler pin 8 and its counter tumbler pin 10 more clearly.

Figure 7:
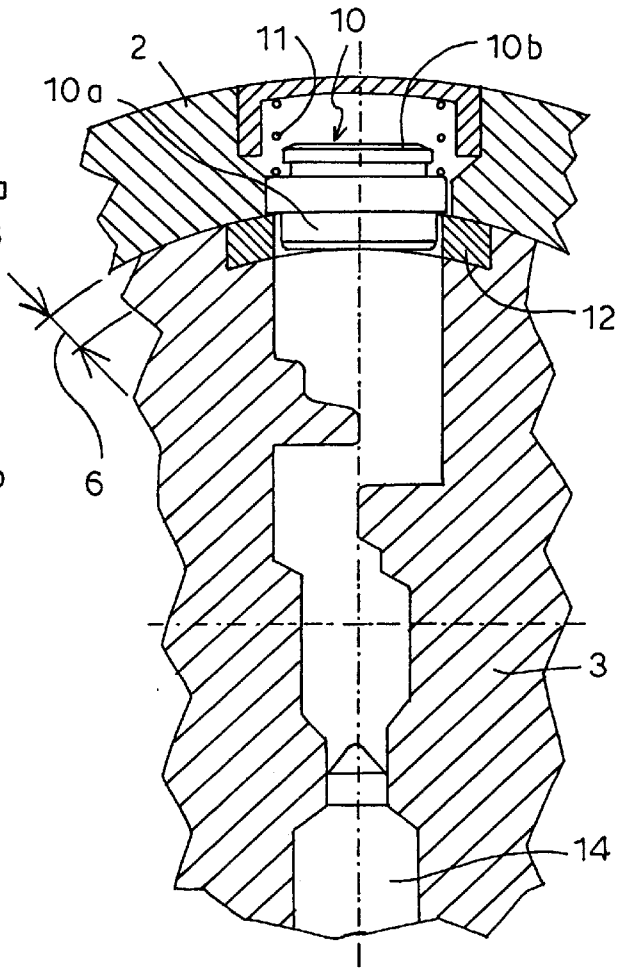

FIG. 7 is similar to FIG. 5, however, it shows the blocking position for counter tumbler pin 10 after key 1 was removed.

Figure 8:
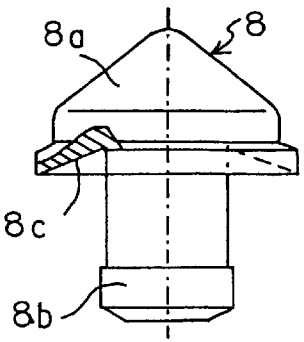

FIG. 8 shows in enlargement tumbler pin 8 together with a partial step that shows tapered recess 8*c*.

Figure 9:
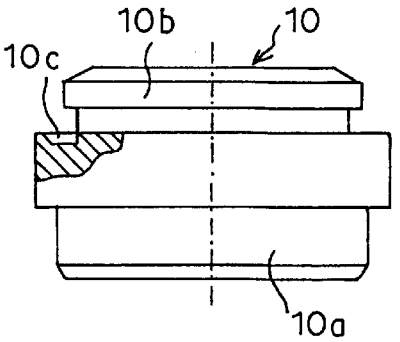

FIG. 9 shows in enlargement counter tumbler pin 10 together with a partial step that shows tapered recess 10*c*.

The reference numerals below are used in these figures:

1 toothed key

1*a* non-toothed longitudinal edge

1*b* toothed longitudinal edge

2 stator of lock cylinder 2-3

3 rotor of lock cylinder 2-3

3*a* key canal of rotor 3 for key 1

4 radius of the non-toothed edge

5 outside radius of rotor 3

6 radial play

7 blind recess of key 1

8 safety tumbler pin

8*a* head of tumbler pin 8

8*b* end part of tumbler pin 8

8*c* tapered recess of tumbler pin 8

9 first spring

10 safety counter tumbler pin

10*a* head of counter tumbler pin 10

10*b* end part of counter tumbler pin 10

10*c* recess of counter tumbler pin 10

11 second spring

12 additional plate

13 openings of additional plate

14 main tumbler pins

15 main counter tumbler pins

16 spring

EXPLANATION OF A PREFERRED IMPLEMENTATION FORM

Regarding the previously mentioned drawings and reference numerals, a preferred embodiment of the new inventive system of a non-duplicable key and its respective lock cylinder is shown.

According to the invention, the key is a toothed key 1 that cooperates with a lock cylinder 2-3 with European format. At its smooth or non-toothed edge, one or a plurality of safety tumbler pins 8 is (are) inserted (in FIG. 1), two such tumbler keys are provided for the purpose of collaborating with respective counter tumbler keys 10, which are inserted into stator or housing 2 of lock cylinder 2/3, as soon as key 1 was inserted into the key canal of rotor 3 that has been made by chisel processing.

In the new system, the distance between the theoretical rotating center and non-toothed edge 1*a* of the key, i.e., radius 4 of the non-toothed edge, is smaller than outside radius 5 of rotor 3, when key 1 is inserted, wherein the key has at least one blind recess 7 with a relatively strong first compression spring 9 and one safety tumbler pin 8 in its non-toothed edge 1*a*, which safety tumbler pin 8 has protruding and compressed positions regarding blind recess 7 according to the respective cases of extension and compression of first spring 9. If key 1 is inserted with the correct combination, this safety tumbler pin is aligned radially and in contact with safety counter tumbler pin 10 inserted in a seat of stator 2 and that is spring-loaded via a second relatively weak compression spring 1 wherein this counter tumbler pin 10 can assume protruding and recessing positions in this seat according to the extended or compressed condition of second spring 11 and in contact between safety tumbler pin 8 and safety counter tumbler pin 10 is achieved via opening 13 in additional plate 12, which is inserted into rotor 3. The thickness of additional plate 12 equals the difference between radius 4 of the non-toothed edge of the key and outer radius 5 of the rotor. Safety tumbler pins are arranged in positions in longitudinal direction that do not coincide with the positions of sets of tumbler pins/counter tumbler pins 14, 15 of the main tumbler or the lock secret of the lock.

The functionality of the system provides that, when key 1 is removed, each safety counter tumbler pin 10 is inserted through its corresponding opening 13 (FIG. 7) in safety plate 12, which results in a rotation blocking in addition to the rotation blocking that is caused by tumbler pin/counter tumbler pin sets 14–15, which are provided for the design of the main lock secret in reference to the toothed edge of the stem of key 1. If a key of the correct toothing is inserted that, however, does not have safety counter pins 8 in its smooth edge of the stem, the main lock secret is fulfilled. Due to safety counter tumbler pin 10, a rotation blocking of rotor 3 is still achieved. The condition of non-duplicability is achieved thus that a key that has been duplicated by a simple method of copying its toothing, cannot be used due to the addition of safety tumbler pin 8, the complicated insertion of which can only be achieved under the control of the manufacturer. If, however, in addition to the fulfillment of the lock secret in reference to its toothing, the insertion of correct key 1 (FIG. 6) results in safety tumbler pin 8 causing safety counter tumbler pin 10 to be pushed back, resulting in the release of the rotation movement of rotor 1, wherein first spring 9 is stronger than second spring 11. Rotor 3 rotates, additional plate 12 holds main counter tumbler pins 15 in their combination at the proper time, because their openings 13 do not coincide with the positions of main counter tumbler pins 15.

Additional plate 12 shown in FIG. 3 corresponds to a general configuration that is provided with five openings 18, wherein these openings always correspond with the number of safety tumbler pins inserted in the non-toothed edge of key 1.

In addition, this safety tumbler pin 8 (FIG. 8) includes protruding head 8*a* and end part 8*b*, which is guided internally, whereas head 8*a* has a preferably tapered recess at its connection point with end part 8*b*, which recess provides support for the respective end of first spring 9. Thus, the above mentioned gain regarding the possible axial stroke of safety tumbler pin 8 is achieved within the narrow space available in this arrangement.

In the same manner, safety counter tumbler pin 10 also has protruding head 10*a* and internally guiding end part 10*b*, whereas head 10*a* has recess 10*c* at its connection point with end part 10*b*, which recess provides support for the respective end of second spring 11.

Having described the characteristics of the present invention and its commercial embodiment, it can only be added that, regarding their entirety and their components, it is possible to make changes to the form, materials and arrangement within the scope of the invention, provided that these changes do not deviate from the basic idea.

What is claimed is:

1. A system having a non-duplicatable key and a lock cylinder for the key, the system comprising a key including a stem having opposed first and second edges wherein the first edge of the key stem has a succession of protrusions and recesses that can form a lock secret and the second edge has at least one hole, a safety tumbler pin disposed in the hole the safety tumbler pin having a first position protruding beyond the second edge of the kev stem and a second position within the hole in the key, and means in the hole for biasing the safety tumbler pin to the first position, a lock cylinder including a stator and a rotor having a longitudinal keyway, the rotor rotatably disposed in the stator, a plurality of tumbler pins and counter tumbler pins stacked in aligned radial openings in the stator and rotor, wherein in a first position of the tumbler pins and counter tumbler pins the counter tumbler pins are in the plane of rotation of the rotor and, when the kev is inserted in the keyway, the protrusions and recesses move the tumbler pins and counter tumbler pins to a second position where the plane of separation between the pins coincides with the plane of rotation of the rotor so that the rotor may rotate in the stator, and means for biasing the pins to the first position, wherein the distance between the axis of rotation of the rotor and the second edge of the key when the key is in the rotor is smaller than the outside radius of the rotor, a plate mounted in a peripheral, longitudinal groove in the rotor wherein the thickness of the plate equals the difference between the distance from the axis of rotation of the rotor to the second edge of the key when the key is in the rotor and the outside radius of the rotor the plate having at least one through hole which opens into the keyway, a safety counter tumbler pin moveably disposed in the stator, the safety counter tumbler pin having a first position where at least a portion of the safety counter tumbler pin is in the hole in the plate for blocking rotation of the rotor and a second position in the stator and out of the plane of rotation of the rotor, and means for biasing the safety counter tumbler pin to the first position, so that when the key is inserted into the keyway the safety tumbler pin is aligned with the safety counter tumbler pin through the hole in the plate for moving the safety counter tumbler pin to the second position, and the hole in the plate is arranged in the longitudinal direction in a position that does not coincide with the sets of tumbler pins and counter tumbler pins of the main combination or the lock secret of the lock so that the rotor may rotate in the stator when the key is in the keyway.

2. The system having a non-duplicable key and a lock cylinder for the key as recited in claim 1, wherein the means for biaisng the safety tumbler pin comprises a spring and the safety tumbler pin comprises a head portion protruding from the second edge of the key in the first postion of the safety tumbler pin and a guide end portion in the hole in the second edge of the key, the head portion having a tapered recess at the junction with the guide end portion forming a support for the respective end of the spring.

3. The system having a non-duplicable key and a lock cylinder for the key as recited in claim 1, wherein the means for biaisng the safety counter tumbler pin comprises a spring and the safety counter tumbler pin comprises a head portion protruding from the stator and into the hole in the plate in the first postion of the safety counter tumbler pin and a guide end portion in the stator, the head portion having a recess at the junction with the guide end portion forming a support for the respective end of the spring.

4. A key blank for use with a cylinder lock including a stator for rotatably receiving a rotor having a keyway, a single pin movably disposed in at least one opening in the stator, the pin biased into a hole in the rotor for blocking rotation of the rotor, the key blank comprising:

an elongated stem having two oppositely disposed principal side surfaces and two edge surfaces extending between and interconnecting the side surfaces, one of the edge surfaces having at least one opening;

a moveable member reciprocally disposed in the opening; and means for biasing the moveable member to a position where the moveable member protrudes from the opening, wherein the movable member is adapted to be moved into the opening in the key stem against the force of the biasing means as the key is inserted into the keyway and, when the moveable member is aligned with the rotor hole, to extend into the rotor hole for engaging the pin in the rotor and moving the pin out of the rotor hole freeing the rotor for rotation in the stator.

5. A key blank as recited in claim 4, wherein the biasing means comprises a spring disposed in the edge surface opening between the key surface and the movable member.

6. A key blank as recited in claim 4, wherein the edge surface of the key has a plurality of openings and further comprising a moveable member reciprocally disposed in each opening for engaging a corresponding plurality of movable pins in the rotor and moving the pins out of the associated rotor holes freeing the rotor for rotation in the stator.

7. A key blank as recited in claim 4, wherein the other edge surface of the stem has at least one opening and further comprising:

a moveable member disposed in the opening in the other edge surface; and means for biasing the moveable member in the other edge surface to a position where the moveable member protrudes from the opening in the other edge surface, wherein the movable member in the other edge surface is adapted to be moved into the opening in the key stem against the force of the biasing means when the key is inserted in the keyway and to extend into a rotor hole for engaging a corresponding pin in the rotor hole and moving the pin out of the rotor freeing the rotor for rotation in the stator.

8. A key blank as recited in claim 7, wherein the biasing means comprises a spring disposed in the other edge surface opening between the other key edge surface and the movable member in the other edge surface.

9. A key blank for use with a cylinder lock including a stator for rotatably receiving a rotor having a keyway, a plurality of pin tumblers reciprocally disposed in longitudinally-spaced holes in the stator and rotor, the holes in the rotor and stator alignable in a first position of the rotor so that the pin tumblers are blockingly positioned in the plane of rotation of the rotor, and a single pin movably disposed in at least one opening in the stator, the pin biased into a hole in the rotor in the first position of the rotor, the key blank comprising:

an elongated stem having two oppositely disposed major side surfaces and first and second edge surfaces extending between and interconnecting the side surfaces, wherein the first edge surface comprises a succession of recesses and projections adapted to movably engage the pin tumblers in the cylinder lock for positioning the pin tumblers out of the plane of rotation of the rotor, and the second edge surface has at least one opening;

a moveable member reciprocally disposed in the opening; and means for biasing the moveable member to a position where the moveable member protrudes from the opening, wherein the movable member is adapted to be moved into the opening in the key stem against the force of the biasing means when the key is inserted into the keyway and, when the moveable member is aligned with the rotor hole, to extend into the rotor hole for engaging the pin in the rotor hole and moving the pin out of the rotor freeing the rotor for rotation in the stator.

10. A key blank as recited in claim 9, wherein the second edge surface of the key has a plurality of openings and further comprising a moveable member reciprocally disposed in each opening for engaging a corresponding plurality of movable pins in the rotor and moving the pins out of the associated rotor holes freeing the rotor for rotation.

11. A cylinder lock, comprising:

a stator having at least one hole for receiving a pin;

a rotor disposed for rotation in the stator, the rotor having a longitudinal slot extending inwardly from an end face of the rotor for receiving a key stem, the rotor slot defined by two oppositely disposed major side walls and at least one edge wall extending between and interconnecting the side walls, the rotor also having at least one hole opening into the slot through the edge wall, the rotor hole alignable with the stator hole in a first position of the rotor;

a single pin movably disposed in the stator hole; and means for biasing the pin to a position where a portion of the pin projects into the rotor hole in the first position of the rotor for blocking rotation of the rotor, wherein the pin is adapted so that, upon engagement with a proper key inserted into the slot, the pin is moved into the stator and outside the plane of rotation of the rotor for permitting rotation of the rotor relative to the stator.

12. A cylinder lock as recited in claim 11, wherein the biasing means is a spring disposed in the stator hole between the stator surface and the pin.

13. A cylinder lock as recited in claim 11, wherein the edge wall comprises a plate member mounted in a recess in the periphery of the rotor, the plate member having a hole alignable with the stator hole in the first position of the rotor.

14. A cylinder lock as recited in claim 11, wherein the slot in the rotor is defined by a second edge wall extending between and interconnecting the side walls, the stator has a second hole for receiving a pin and the rotor has a second hole opening into the slot through the second edge wall, the second rotor hole alignable with the second stator hole in the first position of the rotor, and further comprising a solid pin movably disposed in the second stator hole and means for biasing the pin to a position where a portion of the pin projects into the second rotor hole in the first position of the rotor for blocking rotation of the rotor, wherein the pin is adapted so that, upon engagement with a properly configured key inserted into the slot, the pin is moved into the stator and outside the plane of rotation of the rotor for permitting rotation of the rotor relative to the stator.

15. A cylinder lock as recited in claim 14, wherein the at least one rotor and stator holes and the second rotor and stator holes are longitudinally misaligned.

16. A cylinder lock as recited in claim 11, wherein the stator has a plurality of holes for receiving pins and the rotor also having a plurality of holes opening into the slot through the edge wall, the rotor holes alignable with the stator holes in the first position of the rotor, and further comprising solid pins movably disposed in the stator holes, means for biasing the pins to a position where a portion of the pins projects into the corresponding rotor holes in the first position of the rotor for blocking rotation of the rotor, wherein the pins are adapted so that, upon engagement with a proper key inserted into the slot, the pins are moved out of the rotor and outside the plane of rotation of the rotor for permitting rotation of the rotor relative to the stator.

17. A cylinder lock as recited in claim 11, wherein the cylinder lock has a plurality of longitudinally-spaced, alignable holes formed in each of the rotor and stator and further comprising movable pin tumblers disposed in the holes, the pin tumblers biased into the rotor slot and extending across the plane of rotation of the rotor blocking rotation of the rotor, the pin tumblers adapted to be positioned by a properly configured key inserted into the rotor slot so that a shear line defined by each of the pin tumblers registers with the plane of rotation of the rotor permitting rotation of the rotor relative to the stator.

18. A cylinder lock as recited in claim 17, wherein the pin tumblers comprise a tumbler pin disposed in each rotor hole for rotation with the rotor, a counter tumbler pin disposed in each stator hole, and means for biasing the pin tumblers into the rotor-blocking position, wherein the interface between the tumbler pin and counter tumbler pin defines the shear line.

19. A cylinder lock as recited in claim 17, wherein the stator pin hole is longitudinally misaligned with the plurality of pin tumbler holes.

20. A high security cylinder lock system, the system comprising:

a lock cylinder, comprising:

a stator having at least one opening, a rotor disposed for rotation in the stator, the rotor having a longitudinal slot extending inwardly from an end face of the rotor for receiving a key stem, the rotor slot defined by two oppositely disposed major side walls and at least one edge wall extending between and interconnecting the side walls, the rotor having at least one opening formed in the edge wall of the slot, the opening in the rotor alignable with the opening in the stator in a first position of the rotor, a single pin movably disposed in the stator opening, and means for biasing the pin to a position where a portion of the pin is in the rotor hole bridging the plane of rotation of the rotor; and a key, comprising:

an elongated stem receivable in the rotor slot, the stem having two oppositely disposed major side surfaces and two edge surfaces extending between and interconnecting the side surfaces, one of the edge surfaces having at least one opening, a camming element reciprocably disposed in the edge opening, and means for biasing the camming element to a position where the camming element protrudes from the opening in the edge surface of the key, the camming element biasing means generating greater force on the camming element than the biasing force generated by the stator pin biasing means on the stator pin, wherein the camming element is moved into the opening in the edge of the key stem as a result of the progressive insertion of the key stem into the rotor slot and, when the camming element registers with the rotor hole, the camming element is biased out of the key stem edge opening for engaging the stator pin in the rotor hole and moving the stator pin against the force of the stator biasing means out of the plane of rotation of the rotor freeing the rotor for rotation in the stator.

21. A high security cylinder lock system as recited in claim 20, wherein the stator and rotor have a plurality of holes, the rotor holes opening into the slot through the edge wall and being alignable with the stator holes in the first position of the rotor, and further comprising solid pins movably disposed in the stator holes, means for biasing the pins to a position where a portion of the pins projects into the corresponding rotor holes in the first position of the rotor for blocking rotation of the rotor, and wherein the edge surface of the key has a plurality of openings and further comprising a camming element reciprocally disposed in each opening for engaging the corresponding movable pin in the rotor and moving the pins out of the associated rotor holes freeing the rotor for rotation in the stator.

22. A high security cylinder lock system as recited in claim 20, wherein the slot in the rotor is defined by a second edge wall extending between and interconnecting the side walls, and the stator has a second opening for receiving a pin and the rotor has a second opening through the second edge wall, the second rotor opening alignable with the second stator opening in the first position of the rotor, and further comprising a solid pin movably disposed in the second stator hole and means for biasing the pin to a position where a portion of the pin projects into the second rotor hole in the first position of the rotor for blocking rotation of the rotor, wherein the other edge surface of the key stem has at least one opening, and further comprising a camming element disposed in the opening in the other edge surface, and means for biasing the camming element in the other edge surface to a position where the camming element protrudes from the opening in the other edge surface, and wherein the camming element in the other edge surface is adapted to be moved into the opening in the key stem against the force of the biasing means when the key is inserted into the keyway and to extend into the second rotor hole for engaging the pin and moving the pin out of the rotor freeing the rotor for rotation in the stator.

23. A high security cylinder lock system as recited in claim 20, wherein the cylinder lock has a plurality of longitudinally-spaced, alignable holes formed in each of the rotor and stator and further comprising movable pin tumblers in the holes, the pin tumblers biased into the rotor slot and extending across the plane of rotation of the rotor blocking rotation of the rotor, and the other edge surface of the key comprises a succession of recesses and projections adapted to movably engage the pin tumblers in the cylinder lock for positioning the pin tumblers so that a shear line defined by each of the pin tumblers registers with the plane of rotation of the rotor permitting rotation of the rotor relative to the stator.

24. A high security cylinder lock system as recited in claim 20, wherein the edge wall comprises a plate member mounted in a recess in the periphery of the rotor, the plate member having a hole alignable with the stator hole in the first position of the rotor.

25. A high security cylinder lock system as recited in claim 24, wherein the plate member has a thickness equal to the difference between the distance from the axis of rotation of the key stem to the edge wall and the radius of the rotor.

26. A cylinder lock, comprising:

a stator having at least one hole for receiving a pin;

a rotor disposed for rotation in the stator, the rotor having a longitudinal slot extending inwardly from an end face of the rotor for receiving a key stem, the rotor slot defined by two oppositely disposed major side walls and at least one edge wall extending between and interconnecting the side walls, wherein the edge wall comprises a plate member mounted in a recess in the periphery of the rotor, the plate member having a hole opening into the slot and alignable with the stator hole in the first position of the rotor;

a solid pin movably disposed in the stator hole; and means for biasing the pin to a position where a portion of the pin projects into the rotor hole in the first position of the rotor for blocking rotation of the rotor, wherein the pin is adapted so that, upon engagement with a proper key inserted into the slot, the pin is moved into the stator and outside the plane of rotation of the rotor for permitting rotation of the rotor relative to the stator.

27. A high security cylinder lock system, comprising:

a lock cylinder, comprising:

a stator having at least one opening, a rotor disposed for rotation in the stator, the rotor having a longitudinal slot extending inwardly from an end face of the rotor for receiving a key stem, the rotor slot defined by two oppositely disposed major side waals and at least one edge wall extending between and interconnecting the side walls, wherein the edge wall comprises a plate member mounted in a recess in the periphery of the rotor, the plate member having a hole opening into the slot and alignable with the opening in the stator hole in a first position of the rotor, a solid pin movably disposed in the stator opening, and means for biasing the pin to a position where a portion of the pin is in the rotor hole bridging the plane of rotation of the rotor; and a key, comprising:

an elongated stem receivable in the rotor slot, the stem having two oppositely disposed major side surfaces and two edge surfaces extending between and interconnecting the side surfaces, one of the edge surfaces having at least one opening, a camming element reciprocably disposed in the edge opening, and means for biasing the camming element to a position where the camming element protrudes from the opening in the edge surface of the key, the camming element biasing means generating greater force on the camming element than the biasing force generated by the stator pin biasing means on the stator pin, wherein the camming element is moved into the opening in the edge of the key stem as a result of the progressive insertion of the key stem into the rotor slot and, when the camming element registers with the rotor hole, the camming element is biased out of the key stem edge opening for engaging the stator pin in the rotor hole and moving the stator pin against the force of the stator biasing means out of the plane of rotation of the rotor freeing the rotor for rotation in the stator.

28. A high security cylinder lock system as recited in claim 27, wherein the plate member has a thickness equal to the difference between the distance from the axis of rotation of the key stem to the edge wall and the radius of the rotor.

* * * * *

UNITED STATES PATENT AND TRADEMARK OFFICE

CERTIFICATE OF CORRECTION

PATENT NO. : 6,125,674
DATED : October 3, 2000
INVENTOR(S) : Luis Angel Ruano Aramburu It is certified that error appears in the above-identified patent and that said Letters Patent is hereby corrected as shown below:

Column 5,
Line 6, after "edges" insert --,--.
Line 9, after "in the hole" insert --,--.
Line 11, delete "kev" and insert therefor --key--.
Line 19, delete "kev" and insert therefor --key--.
Line 31, after "of the rotor" insert --,--.
Line 52, delete "position" and insert therefor --position--.
Line 62, delete "postion" and insert therefor --position--.

Column 10,
Line 26, delete "waals" and insert therefor --walls--.

Signed and Sealed this

Nineteenth Day of June, 2001

*Attest:*

Nicholas P. Godici

*Attesting Officer*

NICHOLAS P. GODICI
*Acting Director of the United States Patent and Trademark Office*